United States Patent [19]

Nims et al.

[11] 4,294,291

[45] Oct. 13, 1981

[54] SHUTTLE RETAINING APPARATUS

[75] Inventors: Philip A. Nims, Charlotte; Roger K. Bollinger, Gastonia, both of N.C.

[73] Assignee: Crompton & Knowles Corporation, New York, N.Y.

[21] Appl. No.: 150,273

[22] Filed: May 15, 1980

[51] Int. Cl.[3] ..... D03D 47/24

[52] U.S. Cl. ..... 139/438; 139/185

[58] Field of Search ..... 139/437, 438, 439, 185, 139/187

[56] References Cited

U.S. PATENT DOCUMENTS 3,875,974 4/1975 Rambousek ..... 139/438

3,895,657 7/1975 Bilek ..... 139/438

4,108,215 8/1978 Osgood ..... 139/438

*Primary Examiner*—Henry Jaudon

[57] ABSTRACT

Shuttle control apparatus for looms having a shuttlebox rotatable 180° from a first, shuttle receiving, position to a second picking position, means for checking and positioning the shuttle to a predetermined picking position within the shuttle box, and means for picking the shuttle. The control apparatus comprises means for guiding and maintaining the shuttle in the predetermined picking position during rotation of the shuttle box and means for braking the shuttle only when it is in the second position.

9 Claims, 8 Drawing Figures

SHUTTLE RETAINING APPARATUS

BACKGROUND OF THE INVENTION

The present invention relates to control means for a gripper shuttle in which the shuttle is picked alternately from both sides of the loom. Each side of the loom has a shuttle box for receiving the shuttle and a picking mechanism for propelling the shuttle to the opposite side of the loom.

The invention is particularly directed to gripper shuttle looms in which the shuttle box is rotated 180° after receiving the shuttle. This type of loom is shown in the following U.S. patents to V. Svaty: U.S. Pat. Nos. 3,315,709 dated Apr. 25, 1967 and 3,330,305 dated July 11, 1967 and U.S. patent to Rambousek 3,875,974 issued Apr. 8, 1975. In the type of loom disclosed in each of these U.S. patents, the gripper shuttle enters the shuttle box and is checked or braked. The shuttle is positioned within the shuttle box to a predetermined picking and threading position. The filling which has been brought across the loom from the opposite side thereof, is disengaged from the shuttle gripper and a new filling is inserted into the shuttle gripper. The shuttle box is mounted on a turntable which is rotated 180° after the new filling has been inserted into the gripper so that the shuttle is turned 180° with the head of the shuttle pointed towards the end from which it came. Before rotation of the shuttle box, the braking or checking mechanism is released from its checking function on the shuttle and the shuttle is guided so that it remains in the picking position. After the shuttle box has been rotated to the second position, the shuttle is picked out of the shuttlebox. See, for example, the braking mechanism disclosed in the Svaty et al U.S. Pat. No. 3,487,860 dated Jan. 6, 1970.

In looms of the gripper shuttle type, the shuttle must be precisely positioned at a predetermined location for a threading operation and for accurate picking out of the shuttle box. If the shuttle is not precisely positioned for picking, the amount of force transmitted to the shuttle by the picking mechanism will vary and this results in an inaccurate shuttle flight. If the picking force is insufficient to propel the shuttle completely through the warp shed to the opposite side of the loom, the lay will trap the shuttle in the warp shed. It is well known in the weaving art to positively position a shuttle that has been received into the shuttle box, so that it is in a predetermined position for threading and picking. Shuttle positioning means are shown for example, in the above described patents to Svaty and Rambousek. However, the mechanism for braking or checking the shuttle and for positioning the shuttle must be disengaged from the shuttle before the time of picking. In the case of a rotating shuttle box, the braking mechanism must be released before rotation of the shuttle box. During the time period between release of the braking mechanism and picking of the shuttle, there exists the possibility of the shuttle being moved out of the predetermined picking position by external forces, such as loom vibration and the tension exerted by the filling in the shuttle gripper. In the prior art looms, means are provided for guiding the shuttle as the shuttle box rotates so that the shuttle remains in the predetermined picking position. However, the shuttle can only be guided until the shuttle box reaches the second position to allow the shuttle to be picked. Therefore, when the shuttle box is in the second position, there is a tendency for the shuttle to be pulled away from the picking mechanism. The type of loom to which the present invention is particularly directed, as shown in the Svaty patents, supra, includes means for picking the shuttle. The picking means comprise a piston to which is attached a picking member that engages the end of the shuttle. If the shuttle is not properly positioned close to the end of the picking member, the end of the shuttle will be struck abruptly, thereby producing a high initial acceleration which causes the filling to break.

The problem resulting from the lack of control of the shuttle during the period just prior to picking of the shuttle have been partially solved by the control mechanism shown in U.S. patent to Osgood U.S. Pat. No. 4,108,215 issued Aug. 22, 1978. In this patent, a biased restraining member is located along the groove of the shuttle box in which the shuttle is slidingly guided. The restraining member employs a braking force to the shuttle as long as it is in the shuttle box. This braking force is sufficient to maintain the shuttle in the desired picking position, but does not prevent the shuttle from being picked out of the shuttle box. Although the mechanism shown in the Osgood patent performs satisfactorily when it is first installed, after a short period of time, the problems that it was intended to solve begin to reappear. A variety of loom malfunctions occur. The problem is compounded by the fact that it is not readily apparent that the malfunctions are caused by a loss in effectiveness of the restraining member, therefore, as the restraining member begins to fail it creates a severe diagnostic problem for the loom fixer. Even when the restraining member is suspected as being the source of a problem, that fact cannot be completely determined until the faulty restraining member is replaced by a new one. Upon examining the faulty restraining member, its ineffectiveness appears to be due to either excessive wear of the member or a fracture in the member or the biasing means which urges the member against the projectile when it is in the groove of the shuttle box. These and other difficulties experienced with the prior art devices for looms operating with rotating shuttle boxes have been obviated in a novel manner by the present invention.

It is, therefore, a principal object of the invention to provide a shuttle control apparatus which maintains the shuttle in a predetermined picking position until the time of picking without interfering with the picking of the shuttle out of the shuttle box.

Another object of this invention is the provision of a shuttle control apparatus which applies a restraining or braking force to the shuttle only after the shuttle box has been rotated to its second or picking position.

A further object of the present invention is the provision of a shuttle control apparatus in which the restraining force on the shuttle is maintained for only a brief period of time at the beginning of the picking stroke.

It is another object of the instant invention to provide a shuttle control apparatus which is simple in operation, reliable and capable of a long life of useful service.

SUMMARY OF THE INVENTION

In general, the invention consists of a shuttle control apparatus for loom having a shuttle box rotatable 180° from a first position for receiving a shuttle to a second position for allowing the shuttle to be picked out of the shuttle box. The loom also includes means for checking and positioning the shuttle along its longitudinal axis to a predetermined position within the shuttle box, and shuttle picking means. The shuttle control apparatus comprises means for guiding and maintaining the shuttle in the predetermined picking position during rotation of the shuttle box, a shuttle brake normally disposed in a non-braking mode and operable to a braking mode, and brake actuating means for operating the shuttle brake to the braking mode when the shuttle box is in its second position. The braking force is sufficient to maintain the shuttle in said predetermined picking position but insufficient to prevent the shuttle from being picked.

More specifically, the shuttle brake includes a braking element mounted adjacent the entrance of the shuttle box when it is in the first position for rotation therewith so that the brake is moved to a position adjacent the picking mechanism when the shuttle box is in the second position. The brake actuating means are located adjacent the picking mechanism for engaging the braking element as the shuttle box approaches the second position. This causes the braking element to assume the braking mode in which the braking element is effective to brake or restrain the shuttle in the predetermined picking position.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
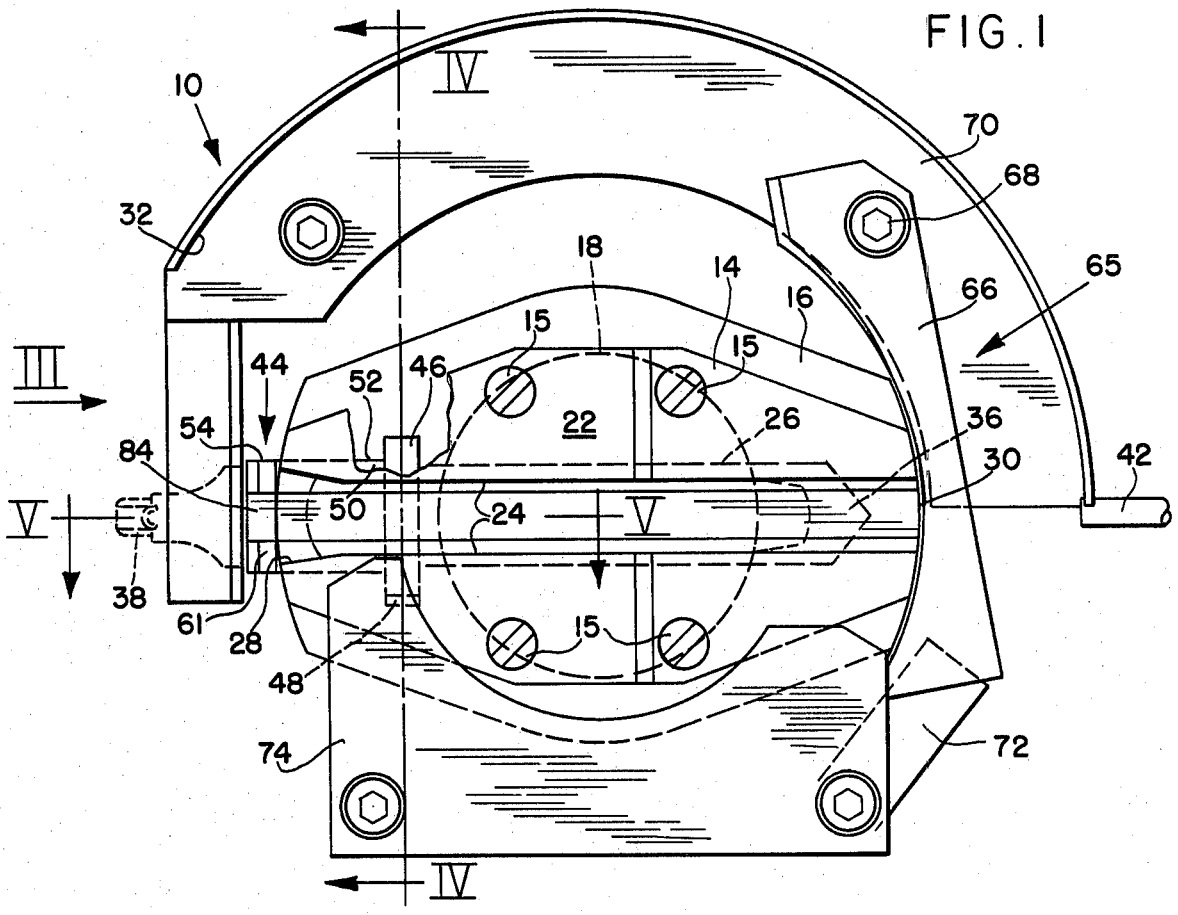
FIG. 1 is a front elevational view of the shuttle control apparatus of the present invention in which the shuttle box is shown in the first or shuttle receiving position.
Figure 2:
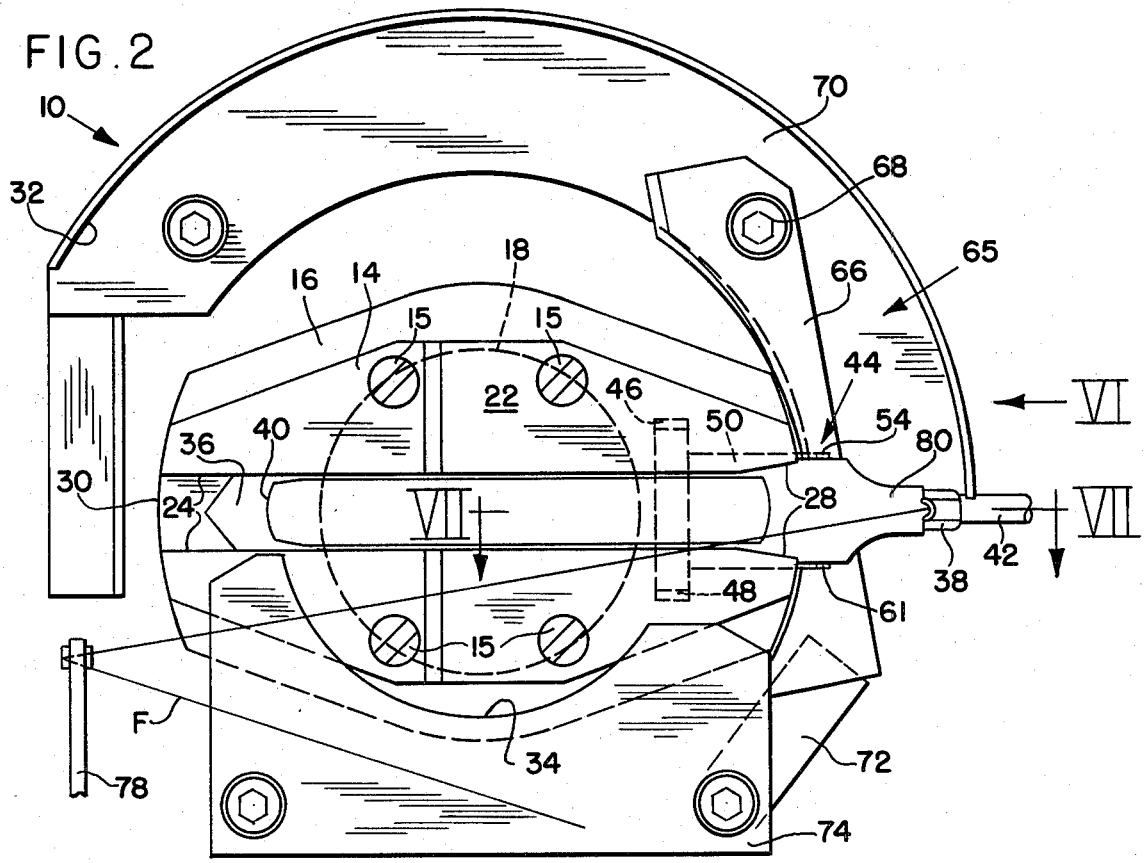
FIG. 2 is a front elevational view similar to FIG. 1 showing the shuttle box in the second or shuttle picking position.
Figure 4:
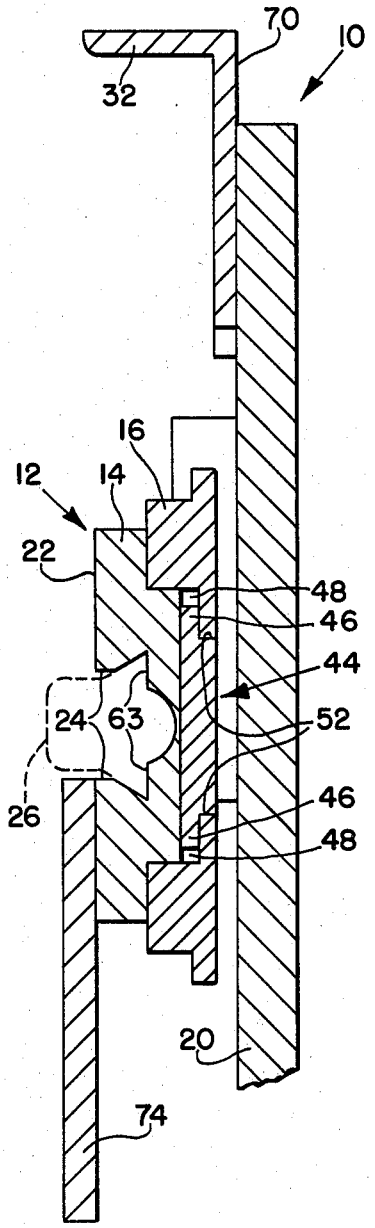
FIG. 4 is a vertical cross-sectional view taken along line IV—IV of FIG. 1, looking in the direction of the arrows.

Referring particularly to FIGS. 1, 2 and 4, the shuttle control apparatus of the present invention is generally indicated by the reference numeral 10 and includes a shuttle box generally indicated by reference numeral 12. The shuttle box shown in FIGS. 1 and 2 is designed for application to the right-hand side of the loom. A similar shuttle box is located at the left-hand side of the loom but of opposite hand.

Figure 5:
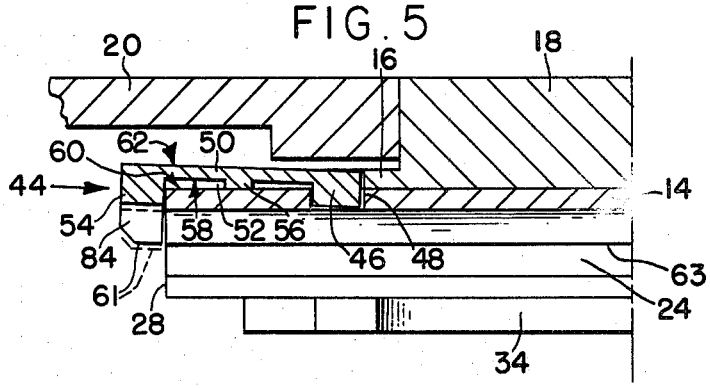
FIG. 5 is a horizontal sectional view taken along line V—V of FIG. 1, looking in the direction of the arrows.

Referring also to FIGS. 4 and 5, shuttle box 12 comprises a face plate 14 fixed by means of screws 15 to a turn-plate 16. Turn plate 16 has a hub 18 which is rotatably mounted in a bearing, not shown, in housing 20 as shown in FIG. 5. Face-plate 14 has a generally flat front surface 22 which includes an elongated groove 24. As shown in FIG. 4, the cross-sectional configuration of groove 24 is generally trapizoidal for receiving the shuttle 26 as shown in dotted lines in FIG. 4. Shuttle 26 has a generally trapizoidal cross-section which enables the shuttle to slide freely along the longitudinal axis of the groove while being maintained in the groove against any movement other than along the longitudinal axis of the groove. One end of the groove 24 has a first opening 28 and the opposite end of groove 24 has a second opening 30. An upper arcuate guideway 32 is located above the shuttle box and a lower arcuate guideway 34 is located in front of the shuttle box below groove 24. The structure, thus far described, is common to looms disclosed in the patents described in the background of the invention. As described in these patents, the shuttle 26 is picked from the left-hand side of the loom and is received into the groove 24 of shuttle box 12 through first opening 28 as viewed in FIG. 1. The leading end 36 of the shuttle enters the groove 24 and the trailing end 38 carries the filling from the opposite side of the loom. The shuttle is checked and positioned to a predetermined threading and picking position within the shuttle box. The filling is then released and a new filling is inserted into the gripper at the trailing end of the shuttle. The shuttle box 12 is rotated 180° so that the leading end 36 is directed toward the left-hand side of the loom as shown in FIG. 2. The shuttle 26 is then picked out of the shuttle box 12 towards the shuttle box located at the left-hand side of the loom. The shuttle box 12 is then rotated 180° in the opposite direction to the position shown in FIG. 1 and is ready to receive the shuttle on its return flight from the left-hand side of the loom.

When the shuttle is received into the shuttle box 12, it is checked or braked by braking mechanism not shown but fully described in U.S. patents to Rambousek and Osgood, supra. The means for releasing the filling that is carried from the opposite side of the loom and for inserting a new filling from the right-hand side of the loom is shown in the Svaty patents, supra. The loom disclosed in each of the U.S. patents, supra, also include means for positioning the shuttle after it has been received into the shuttle box to a predetermined picking position within the groove 24. As the shuttle is rotated 180° from the position shown in FIG. 1 to the position shown in FIG. 2, the trailing end 38 of the shuttle rides along the upper guideway 32. The main body portion of shuttle 26 has an arcuate end surface 40 at the forward end. End surface 40 rides along lower guideway 34 as the shuttle box rotates in the position shown in FIG. 1 to the position shown in FIG. 2. Upper and lower guideways 32 and 34, therefore, maintain the shuttle 26 in the predetermined picking position relative to groove 24 until the shuttle box reaches the second position shown in FIG. 2. At this position, the shuttle is free of the guideways and the trailing end 38 is positioned directly in front of an actuating plunger 42 of the picking mechanism, not shown. Details of the mechanism for checking and positioning the shuttle are not included in this application inasmuch as they are not novel to the present application. These details are shown and described in U.S. Pat. No. 3,875,974. Therefore, further description of this mechanism and its operation is not necessary for an understanding of the present invention and the text of said U.S. patent is incorporated herein by reference.

Referring to FIGS. 1, 4, 5 and 8, a braking element 44 is clamped between face-plate 14 and turn-plate 16. Braking element 44 includes a cross-bar 46 that lies within a cross-slot 48 in the face-plate 14, see FIG. 5. A resilient arm 50 extends from cross-bar 46 towards the first opening 28 and lies within an end slot 52 in turnplate 16, see FIG. 1. A brake shoe 50 is integral with and extends from the other end of arm 50 so that it lies just in front of first opening 28, as shown in FIGS. 1 and 5. A protuberance 56 extends from the forward surface 58 of arm 50 to maintain the arm spaced from the back surface 60 of face-plate 14 as shown in FIG. 5. The forward surface 61 of the brake shoe is thereby maintained rearwardly of the back wall 63 of groove 24 so that when the shuttle enters groove 24, the forward surface 61 of the brake shoe will be spaced from the shuttle. Braking element 44 is therefore normally disposed on the shuttlebox in a non-braking mode as shown in full lines in FIG. 5. However, the braking element is constructed of a resilient material. It is preferred that the braking element be made of high molecular weight polyethelene. Upon application of sufficient pressure against the back surface 62 of the braking element in the area of the brake shoe, the braking element will bend about protuberance 56 so that surface 61 of the brake shoe moves from the full line position rearwardly of back surface 63 of the groove, as shown in FIG. 5, to the dotted line position, forwardly of surface 63. The dotted lines position of brake shoe represents the braking mode of the braking element 44. When the shuttle is located within groove 24, as shown in FIG. 7, and a force is applied to surface 62 which is sufficient to cause the brake shoe to move from the full line position to the dotted line position in FIG. 5, surface 61 will engage the back surface 64 of the shuttle.

Figure 7:
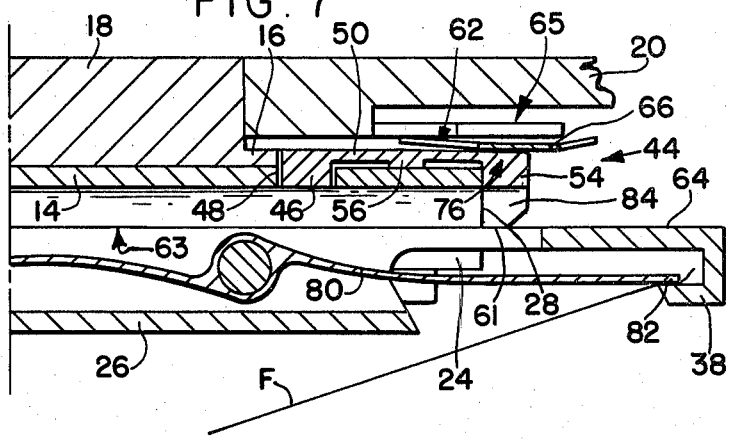
FIG. 7 is a horizontal sectional view taken along line VII—VII of FIG. 1, looking in the direction of the arrows.
Figure 3:
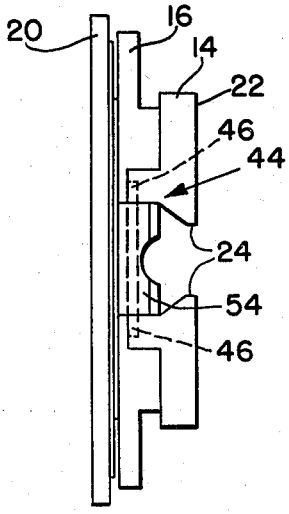
FIG. 3 is a end elevational view of the shuttle box, looking in the direction of Arrow III of FIG. 1.
Figure 6:
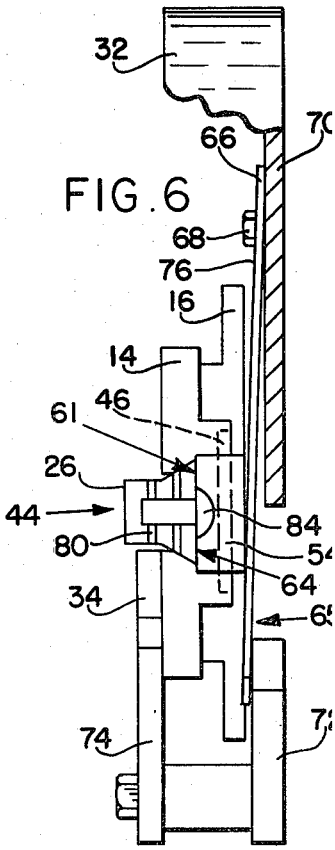
FIG. 6 is end elevational view of the shuttle box looking in the direction of arrow VI of FIG. 2.

The actuating means for applying a bending force to braking element 44 to operate it from its non-braking mode to its braking mode, is shown in FIGS. 1, 2, and 7 and is generally indicated by the reference 65. Actuating means 65 comprises a leaf spring 66, fixed at one end by means of a bolt 68 to a plate 70 which supports the upper guideway 32. The opposite end of spring 66 is supported by a spacer 72. Spacer 72 causes the spring 66 to extend from a position substantially rearward of the back surface 63 of groove 24, adjacent bolt 68, to a position of surface 63 where the leaf spring 66 engages spacer 72. The forward surface 76 of leaf spring 66 is therefore inclined with respect to the back wall 63 of the shuttle box groove 24, as shown in FIG. 6 and intersects the path of travel of the back surface 62 of the braking element 44 resulting from the movement of the shuttle box from the first position shown in FIG. 1 to the second position shown in FIG. 2. As the shuttle box approaches the second position, the back surface 62 gradually engages surface 76 of the spring. Surface 76 functions as a resilient cam surface which applies a gradually increasing pressure against surface 62 of the braking element. Surface 61 of the brake shoe 54 is forced against the back surface 64 of the shuttle, as shown in FIG. 7, thereby operating the braking element 44 to its braking mode to brake or restrain the shuttle against longitudinal movement along the groove 24. This maintains the shuttle in the predetermined picking position in front of the actuating plunger 42 of the picking mechanism as shown in FIG. 2.

Figure 8:
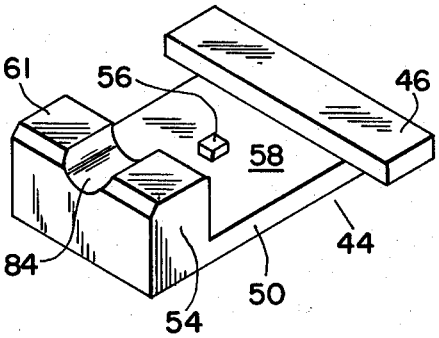
FIG. 8 is a perspective view of the braking element of the present invention.

The operation and advantages of the present invention will now be readily understood, in view of the above description. Referring to FIG. 1, the shuttle box 12 is shown in the first position for receiving a shuttle picked from the opposite side of the loom. The shuttle enters groove 24 through first opening 28. As the shuttle enters the shuttle box, it is checked or braked in the usual manner and positioned along groove 24 to a predetermined picking position shown in dotted lines in FIG. 1. In this position, the filling which has been carried from the opposite side of the loom is released and a new filling is inserted in the gripper at the trailing end of the shuttle. The shuttle box is then rotated 180° about the central axis 84 of hub 18, from the position shown in FIG. 1 to the position shown in FIG. 2, so that the trailing end 38 of the shuttle arrives in front of the actuating plunger 42. During the 180° rotation of the shuttle box, the shuttle is maintained in the predetermined picking position within groove 24 by the guideways 32 and 34. As the trailing end 38 of the shuttle approaches the picking position in front of the actuating plunger 42, the back surface 62 of the braking element 44 engages surface 76 of the leaf spring 66. Resilient arm 50 is gradually deflected towards the shuttle so that surface 61 of the brake shoe engages the back surface 64 of the shuttle to maintain the shuttle in the predetermined picking position within the groove 24, as shown in FIGS. 6 and 7. The shuttle gripper comprises a flat spring 80 which is effective to clamp the filling against a clamping surface 82 at the trailing end of the shuttle. The newly inserted filling F extends from the gripper at the trailing end 38 of the shuttle, as shown in FIG. 2, through a threading member 78 which forms part of the filling inserting mechanism to a supply package, not shown. The filling F is maintained under tension so that in the absence of a restraining or braking force on the shuttle to maintain the shuttle in the predetermined picking position within groove 24, there is a tendency for the filling to displace the shuttle from this picking position toward the second opening 30 and away from actuating plunger 42. After the shuttle has arrived at the picking position shown in FIG. 2, the picking mechanism is operated so that the actuating plunger 42 moves along the central longitudinal axis of the shuttle to pick the shuttle out of the shuttle box through opening 30 to the opposite side of the loom. Although the braking or restraining force applied by the brake shoe 54 to the shuttle is sufficient to maintain the shuttle in the predetermined picking position against forces tending to dislodge the shuttle from this position, such as the filling yarn tension, loom vibration, etc., the braking force is insufficient to prevent picking of the shuttle out of the shuttle box. Since the brake shoe 54 is located adjacent the picking mechanism at the time of picking, braking pressure is applied to the shuttle for a brief period at the beginning of the picking stroke. After the shuttle has moved a short distance along groove 24 toward opening 30, the end of the shuttle clears the brake shoe and is free of any restraining force by the braking element 44. As shown in FIG. 8, the brake shoe 54 is provided with a central semi-circular groove 84 to provide clearance for the actuating plunger 42 during picking. Since the shuttle control apparatus of the present invention applies a braking force to the shuttle only at the time that such a braking force is needed just prior to picking, relative motion between the braking means and shuttle is reduced to an absolute minimum. By applying this braking force to the trailing end of the shuttle, when the shuttle box is in the second position, the effect that the braking means might have on the picking stroke is also minimized. The shuttle is braked only when it is no longer possible to guide the shuttle by means of the upper and lower passageways. The shuttle must be moved to a position where it is no longer in engagement with the guideways in order to be picked out of the shuttlebox. The braking pressure on the shuttle box extends for only a brief period at the beginning of the stroke and it occurs at a time when the picking plunger is still in engagement with the shuttle. This is a far better condition than would be the case if the braking force were applied to the shuttle during any portion of free-flight out of contact with the picking plunger. In addition, this braking force can be compensated for when calculating the picking stroke. The present invention represents a reliable control for the shuttle; providing consistent, trouble-free picking and its effectiveness is increased by the longer working life of the shuttle braking element.

The invention having thus been described, what is claimed as new and desired to secure by Letters Patent is:

1. Shuttle control apparatus for looms having a shuttle box rotatable 180° from a first position for allowing the shuttle to be picked out of the shuttle box, means for checking the shuttle when it enters the shuttle box, means for positioning the shuttle within the shuttle box to a predetermined picking position when the shuttle box is in its first position and means for picking the shuttle when the shuttle box is in its second position, said shuttle control apparatus comprising:

(a) means for guiding the shuttle as it moves from the first position to the second position to maintain the shuttle in said predetermined picking position within the shuttle box;

(b) a shuttle brake normally disposed in a non-braking mode and operable to a braking mode for engaging the shuttle and maintaining the shuttle in the predetermined picking position; and (c) brake actuating means for operating the shuttle brake to the braking mode when the shuttle box is in its second position, said actuating means being effective to cause the shuttle brake to apply a braking force to the shuttle which is sufficient to maintain the shuttle in said predetermined picking position and insufficient to prevent the shuttle from being picked.

2. Shuttle control apparatus as recited in claim 1, wherein the shuttle brake is mounted on the shuttle box for rotation therewith, said shuttle brake being located adjacent the end of the shuttle nearest the picking mechanism when the shuttle box is in its second position.

3. Shuttle control apparatus as recited in claim 2, wherein the shuttle brake comprises a resilient arm, one end of which is fixed to the shuttle box, and a brake shoe mounted on the opposite end of said resilient arm so that the brake shoe is normally out of contact with the shuttle in the shuttle box, and wherein the brake actuator is a cam that engages the shuttle brake when the shuttle box is in its second position to force the brake shoe against the shuttle, whereby the shuttle brake is operated to its braking mode.

4. Shuttle control apparatus as recited in claim 3, wherein the cam is biased toward the shuttle brake.

5. Shuttle control apparatus as recited in claim 4, wherein the cam is a leaf spring.

6. Shuttle control apparatus as recited in claim 5, wherein the leaf spring is disposed at an angle to the plane in which the cam element moves as the shuttle box moves from the first position to the second position, said leaf spring intersecting said plane so that the shuttle brake is gradually engaged by the leaf spring as the shuttle box moves into said second position.

7. Shuttle control apparatus as recited in claim 6, wherein one end of the leaf spring is fixed at a point spaced from said plane and the other end of the leaf spring is supported by a spacer element which is effective to deflect an intermediate portion of the leaf spring into said plane.

8. Shuttle control apparatus as recited in claim 3, wherein the braking element is made of high molecular weight polyethelene.

9. Shuttle control apparatus as recited in claim 1, wherein the shuttle box has a longitudinal groove for holding the shuttle in a sliding relationship along the groove, a first opening at one end of the groove for receiving the shuttle and a second opening at the opposite end of the groove through which the shuttle is picked, said shuttle brake being located adjacent said first opening, said actuating means being located adjacent the picking mechanism.

* * * * *